US009657952B2

(12) United States Patent
Gurlek et al.

(10) Patent No.: US 9,657,952 B2
(45) Date of Patent: May 23, 2017

(54) REDUCING THE ENERGY CONSUMPTION OF AN OVEN

(75) Inventors: Mehmet Zihni Gurlek, Istanbul (TR); Hasan Yoruk, Istanbul (TR); Servet Turgut, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 601 days.

(21) Appl. No.: 14/115,348

(22) PCT Filed: Apr. 30, 2012

(86) PCT No.: PCT/EP2012/057935

§ 371 (c)(1),
(2), (4) Date: Feb. 3, 2014

(87) PCT Pub. No.: WO2012/150227

PCT Pub. Date: Nov. 8, 2012

(65) Prior Publication Data

US 2014/0150672 A1 Jun. 5, 2014

(30) Foreign Application Priority Data

May 2, 2011 (TR) ..... a 2011 04273

(51) Int. Cl.

| | |
|---|---|
| ***F24C 7/08*** | (2006.01) |
| ***F24C 15/00*** | (2006.01) |
| ***F24C 15/32*** | (2006.01) |

(52) U.S. Cl.

CPC ..... *F24C 7/08* (2013.01); *F24C 7/085* (2013.01); *F24C 15/006* (2013.01); *F24C 15/325* (2013.01)

(58) Field of Classification Search

CPC ..... F24C 7/08; F24C 15/325; F24C 7/085; F24C 15/006; F24C 15/32

USPC ..... 99/348, 490; 219/400, 414, 490, 682

See application file for complete search history.

(56) References Cited

U.S. PATENT DOCUMENTS

| | | | | |
|---|---|---|---|---|
| 2002/0179588 | A1* | 12/2002 | Lubrina | A21B 3/04 219/400 |
| 2011/0049124 | A1 | 3/2011 | Crayfourd | |
| 2011/0100977 | A1 | 5/2011 | Akdag et al. | |

FOREIGN PATENT DOCUMENTS

| | | | |
|---|---|---|---|
| EP | 2287533 | A1 | 2/2011 |
| WO | 2009062917 | A2 | 5/2009 |

* cited by examiner

*Primary Examiner* — Thien S Tran

(74) *Attorney, Agent, or Firm* — Kilpatrick Townsend & Stockton LLP

(57) ABSTRACT

The present invention relates to an oven (1) comprising an exterior body (2), a cooking cavity (3) wherein the cooking process is realized, a heater (4) provides the foodstuff placed into the cooking cavity (3) to be cooked, a cooling fan (5) arranged between the exterior body (2) and the cooking cavity (3), that provides air circulation around the cooking cavity (3) and a control unit (6) that provides a cooking process composed of at least three phases, that is the first phase, second phase and third phase to be performed from the start to the end of the cooking.

4 Claims, 1 Drawing Sheet

REDUCING THE ENERGY CONSUMPTION OF AN OVEN

FIELD

The present invention relates to an oven wherein energy saving is provided in the cooking process.

BACKGROUND

During the cooking process realized in ovens, vapor formation in various quantities occurs depending on the type of the food and the quantity of the water. Vapor forming in the cooking cavity is of the utmost importance with respect to the heat transfer realized during the cooking process. In order to attain the desired cooking quality, vapor quantity in the cooking cavity should be controlled. In domestic ovens, the cooling fan is used in order to remove the vapor from the cooking cavity. The vapor is discharged through the ventilation holes bored on the exterior body by means of the cooling fan. By means of the cooling fan, air discharge from the cooking cavity and also cooling process of the electrical components are efficiently realized.

However, using the cooling fan for discharging the vapor from the cooking cavity causes the energy consumption of the oven to increase. The temperature of the cooking cavity decreases with the operation of the cooling fan. This situation causes the heaters to operate for longer durations and thus the energy consumption of the oven increases. On the other hand, in case that the cooling fan does not operate sufficiently, the cooking quality is adversely affected since sufficient vapor cannot be discharged.

In the state of the art German Patent Application No. DE10128370, an oven is described, wherein the motor of the cooling fan is controlled according to the selection function.

In the state of the art European Patent Application No. EP1457740, an oven is described, wherein the cooling fan is provided to be operated at intervals in a predefined order in order to increase energy efficiency.

In the state of the art European Patent Application No. EP2287533, an oven is described, comprising a cooling fan, the operation of which is controlled according to the selected cooking program and the temperature values measured by a temperature sensor arranged near the control unit.

In the state of the art Patent Application No. WO2009062917, an oven is described comprising a control unit that regulates the cooking parameters such as temperature and duration so that energy saving is maintained at different temperature values defined by the user according to the type of food to be cooked.

SUMMARY

The aim of the present invention is the realization of an oven wherein energy saving is provided during cooking without deteriorating the cooking quality.

In the oven realized in order to attain the aim of the present invention, explicated in the first claim and the respective claims thereof, at least a three-phase cooking process is implemented by the control unit from the start to the end of the cooking according to a temperature defined by the user at the start of the cooking process. In the oven of the present invention, the control unit delays the activation of the cooling fan during the first phase and the cooling fan is activated by the control unit in the second phase.

In the oven of the present invention, the first phase is realized at the first temperature defined by the user at the start of cooking, the second phase at a second temperature calculated by the control unit with respect to the first temperature and which is lower than the first temperature and the third phase at a third temperature calculated by the control unit with respect to the first temperature and which is higher than the first and second temperatures.

By delaying the activation of the cooling fan during the first phase, heat loss in the cooking cavity is prevented. Thus, the operation time of the heaters is decreased and total energy consumed by the oven is reduced.

In an embodiment of the present invention, the cooling fan is operated by the control unit at the beginning of the second phase of the cooking process. By the operation of the cooling fan, vapor accumulating in the cooking cavity in the first phase realized at high temperatures is discharged. Thus, cooking quality is improved by preventing condensation from occurring in the cooking cavity.

In another embodiment of the present invention, the moment the cooling fan is activated by the control unit is defined according to the data received from the temperature probe that is used for measuring the central temperature of the cooked food. Temperature change rate is calculated by the control unit according to the data received from the temperature probe and the calculated temperature change rate is compared with the limit temperature change rate determined by the experimental studies performed by the producer. When the calculated temperature change rate is equal to the limit temperature change rate, the control unit provides the operation of the cooling fan. Thus, the cooling fan is provided to be activated depending on the type of the food that is cooked. Consequently, the cooling fan is activated as late as possible depending on the inner temperature of the food that is cooked. By activating the cooling fan as late as possible, energy saving is increased.

In another embodiment of the present invention, the moment the cooling fan is activated is determined according to the temperature of the cooking cavity recorded from the beginning of the second phase by the control unit. The cooling fan is activated by the control unit when the temperature of the cooking cavity reaches the critical temperature value determined by the experimental studies performed by the producer.

By means of the oven of the present invention, the heat of cooking cavity is preserved by providing the cooling fan not to operate during the first phase of the cooking process realized at high temperatures and thus the energy consumed by the oven is reduced by providing the heaters to operate for a less amount of time.

The oven realized in order to attain the aim of the present invention is illustrated in the attached figures, where:

DETAILED DESCRIPTION

Figure 1:
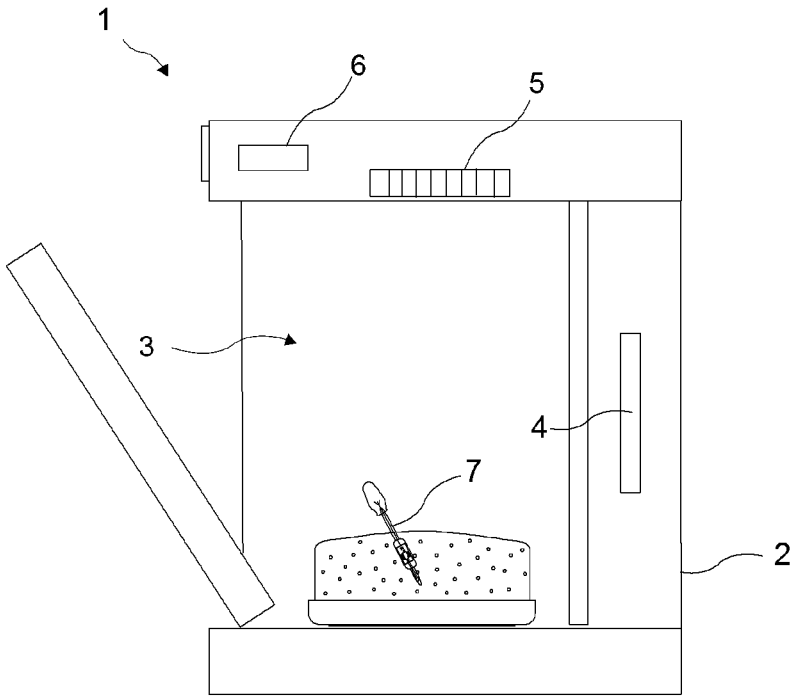
FIG. 1—is the schematic view of an oven.
Figure 2:
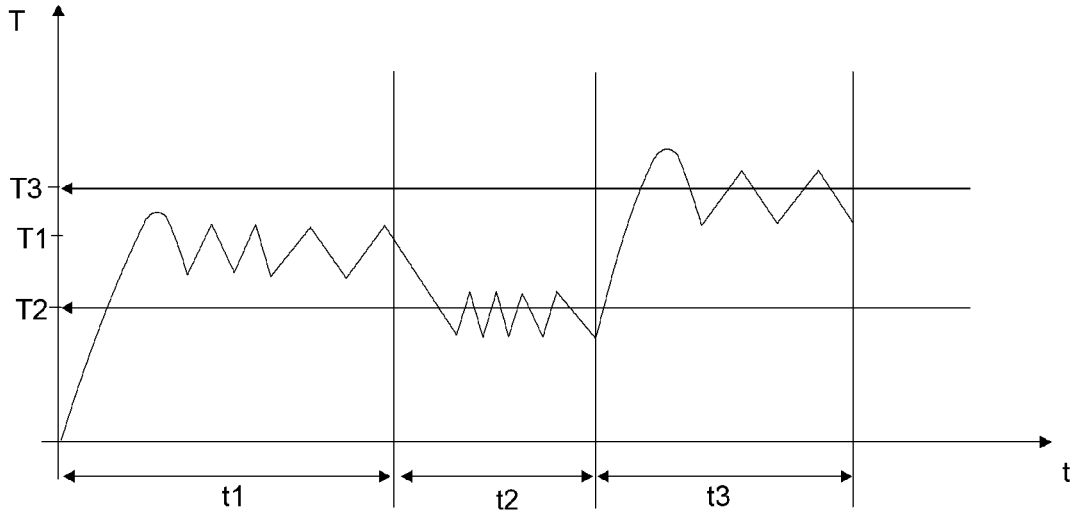
FIG. 2—is the graphic showing the change in the interior temperature of the oven with respect to time in an oven.

The elements illustrated in the figures are numbered as follows:

1. Oven
2. Exterior body
3. Cooking cavity
4. Heater
5. Cooling fan
6. Control unit
7. Temperature probe The oven (1) comprises an exterior body (2), a cooking cavity (3) wherein the cooking process is performed, a heater (4) that provides the foodstuff placed into the cooking cavity (3) to be cooked and a cooling fan (5) arranged between the exterior body (2) and the cooking cavity (3), that provides air circulation around the cooking cavity (3).

Water within the food being cooked heats up during the cooking process and after a certain time, vaporizes and causes the amount of vapor in the cooking cavity (3) to increase. The cooling fan (5), on the one hand, provides the electrical components to be cooled by providing air circulation around the cooking cavity (3), and on the other hand, provides the vapor in the cooking cavity (3) to be discharged by means of the ventilation holes.

The oven (1) of the present invention comprises a control unit (6) that performs the cooking process in at least three phases being the first phase, second phase and third phase from the start to end of the cooking, in the first phase at a first temperature (T1) defined by the user at the start of cooking for a first phase duration (t1), in the second phase, at a second temperature (T2) lower than the temperature (T1) defined by the user for a second phase duration (t2) and in the third phase at a third temperature (T3) higher than the temperatures in the first or second phase for a third phase duration (t3).

In the oven (1) of the present invention, the activation of the cooling fan (5) is delayed by the control unit (6) until the end of the first phase and the cooling fan (5) is activated by the control unit (6) in the second phase. Air is not discharged from the cooking cavity (3) when the cooling fan (5) is not operated during the first phase and thus the cooking cavity (3) is prevented from losing heat. By providing the heater (4) to operate for a less amount of time when the temperature of the cooking cavity (3) is prevented to decrease, the energy consumed by the oven (1) during the first phase is reduced.

In an embodiment of the present invention, the cooling fan (5) is activated by the control unit (6) at the beginning of the second phase. Thus, vapor accumulating in the cooking cavity (3) until the end of the first phase is discharged with the activation of the cooling fan (5). By means of discharging vapor from the cooking cavity (3), cooking quality is improved.

In another embodiment of the present invention, the oven (1) comprises a temperature probe (7) used for measuring the inner temperature of the food being cooked in the cooking cavity (3). The temperature probe (7) is inserted into the food and thus the inner temperature of the food being cooked during the cooking process is measured. In this embodiment, the cooling fan (5) is activated by the control unit (6) when the temperature change rate obtained from the data received from the temperature probe (7) reaches the limit temperature change rate determined by the producer. The temperature of the cooking cavity (3) is preserved by stopping the cooling fan (5) until the temperature change rate obtained from the data measured by the temperature probe (7) reaches the limit temperature change rate. Thus by activating the cooling fan (5) as late as possible, the energy consumed by the oven (1) is reduced and energy saving is provided.

In another embodiment of the present invention, the cooling fan (5) is activated by the control unit (6) when the temperature of the cooking cavity (3) measured from the beginning of the second phase reaches the critical temperature value obtained by the experimental studies performed by the producer. Thus, the cooling fan (5) is provided to be activated at the end of a duration that optimizes the energy consumed by the oven (1) and the cooking quality.

In the oven (1) of the present invention, energy saving is provided by realizing the three phase cooking process at the first temperature (T1), defined by the user at the start and which is greater than the second temperature (T2) for a shorter time period and at the second temperature (T2) that is lower than the first and third temperatures (T1, T3) for a longer time period. Moreover, by preventing the cooling fan (5) from operating during the first phase, energy saving is improved.

It is to be understood that the present invention is not limited to the embodiments disclosed above and a person skilled in the art can easily introduce different embodiments. These should be considered within the scope of the protection postulated by the claims of the present invention.

The invention claimed is:

1. An oven (1) comprising an exterior body (2), a cooking cavity (3) wherein a cooking process is performed, a heater (4) that provides foodstuffs placed into the cooking cavity (3) to be cooked, a cooling fan (5) arranged between the exterior body (2) and the cooking cavity (3), that provides air circulation around the cooking cavity (3), and a control unit (6) configured to perform the cooking process in at least three phases from a start to end of the cooking process, the three phases including a first phase having a first phase duration (t1), a second phase a second phase duration (t2) and a third phase a third phase duration (t3), wherein a first predetermined temperature (T1) is defined by a user at the start of cooking process for the first phase duration (t1), a second predetermined temperature (T2) is defined by the user for the second phase duration (t2) such that the second predetermined temperature (T2) is lower than the first predetermined temperature (T1), and a third predetermined temperature (T3) is defined by the user for the third phase duration (t3) such that the third temperature (T3) is higher than the first predetermined temperature (T1) and the second predetermined temperature (T2), wherein the control unit is further configured to delay an activation of the cooling fan (5) until an end of the first phase, and to activate the cooling fan in the second phase.

2. The oven as in claim 1, wherein the oven control unit (6) is configured to activate the cooling fan when the second phase begins.

3. The oven (1) as in claim 1, further comprising a temperature probe (7) used for measuring the inner temperature of a food being cooked in the cooking cavity (3) and wherein the control unit is configured to activate the cooling fan (5) when temperature change rate obtained from data received from the temperature probe (7) reaches a limit temperature change rate.

4. The oven (1) as in claim 1, wherein the control unit is configured to activate the cooling fan (5) when a temperature of the cooking cavity (3) measured when the second phase begins reaches a critical temperature value.

* * * * *